US011359581B2

(12) United States Patent
Miller

(10) Patent No.: US 11,359,581 B2
(45) Date of Patent: Jun. 14, 2022

(54) HYDROGEN PRODUCTION SYSTEM FOR INTERNAL COMBUSTION ENGINES

(71) Applicant: David D. Miller, Fredericktown, OH (US)

(72) Inventor: David D. Miller, Fredericktown, OH (US)

( * ) Notice: Subject to any disclaimer, the term of this patent is extended or adjusted under 35 U.S.C. 154(b) by 0 days.

(21) Appl. No.: 17/227,338

(22) Filed: Apr. 11, 2021

(65) Prior Publication Data

US 2021/0317802 A1 Oct. 14, 2021

Related U.S. Application Data

(60) Provisional application No. 63/008,773, filed on Apr. 12, 2020.

(51) Int. Cl.
*F02M 25/025* (2006.01)
*F02M 35/104* (2006.01)
(Continued)

(52) U.S. Cl.
CPC ..... *F02M 25/025* (2013.01); *C25B 1/042* (2021.01); *C25B 9/17* (2021.01); *C25B 9/65* (2021.01);
(Continued)

(58) Field of Classification Search
CPC ..... F02M 25/025; F02M 25/0222; F02M 35/10222; F02M 35/10373; F02M 35/104;
(Continued)

(56) References Cited

U.S. PATENT DOCUMENTS 2,006,676 A 7/1935 Garrett
6,257,175 B1 7/2001 Mosher et al.
(Continued)

FOREIGN PATENT DOCUMENTS

WO 2008063967 A2 5/2008
WO WO-2012096728 A1 * 7/2012 ..... C25C 7/02
WO 201800598 A1 1/2018

OTHER PUBLICATIONS

"Aquatune International," printed Apr. 3, 2021: https://aquatuneinternational.com/.
(Continued)

*Primary Examiner* — Jacob M Amick
*Assistant Examiner* — Charles J Brauch
(74) *Attorney, Agent, or Firm* — Nath, Goldberg & Meyer; Richard C. Litman

(57) ABSTRACT

The hydrogen production system for internal combustion engines includes an intake air scoop, a vacuum block having an air input port system for receiving air from the intake air scoop, a water reservoir connected to the vacuum block for providing water to be mixed with the air in the vacuum block, at least one primary generator assembly with an inlet port for receiving the air/water vapor mixture from the vacuum block and producing a mixture of hydrogen, produced oxygen, and fine hydrogen production vapor from a partially oxidized water fog, and a plurality of secondary hydrogen generator assemblies connected to the primary generator assembly for receiving this mixture. The engine vacuum draws this mixture into the intake manifold to provide an ideal fuel mixture for the engine.

17 Claims, 8 Drawing Sheets

(51) Int. Cl.

| | |
|---|---|
| ***F02M 35/10*** | (2006.01) |
| ***F02M 25/022*** | (2006.01) |
| ***C25B 9/65*** | (2021.01) |
| ***C25B 1/042*** | (2021.01) |
| ***C25B 9/17*** | (2021.01) |
| ***C25B 15/08*** | (2006.01) |

(52) U.S. Cl.
CPC ..... *C25B 15/08* (2013.01); *F02M 25/0222* (2013.01); *F02M 35/104* (2013.01); *F02M 35/10222* (2013.01); *F02M 35/10373* (2013.01)

(58) Field of Classification Search
CPC ..... F02M 35/10209; F02M 21/0206; F02M 21/0215; F02M 35/10386; C25B 1/042; C25B 9/17; C25B 9/65; C25B 15/08; C25B 1/044; C25B 9/015; C25B 9/07; C25B 9/70; C25B 15/023; C25B 15/081; Y02E 60/36
See application file for complete search history.

(56) References Cited

U.S. PATENT DOCUMENTS

| | | | |
|---|---|---|---|
| 9,340,881 | B2 | 5/2016 | Packer |
| 2008/0092831 | A1 | 4/2008 | Simon |
| 2010/0181190 | A1 | 7/2010 | Romaniuk |
| 2016/0244887 | A1 | 8/2016 | Haywood |

OTHER PUBLICATIONS

Anderson, "Electrolytic Carburetor Patent," Network 6000 ©2018: https://www.electricitybook.com/electrolytic-carburetor/.

* cited by examiner

HYDROGEN PRODUCTION SYSTEM FOR INTERNAL COMBUSTION ENGINES

CROSS-REFERENCE TO RELATED APPLICATION

This application claims the benefit of U.S. Provisional Patent Application No. 63/008,773, filed on Apr. 12, 2020.

BACKGROUND

1. Field

The disclosure of the present patent application relates to internal combustion engines, and particularly to a hydrogen production system for internal combustion engines.

2. Description of the Related Art

In general, water and hydrogen injection systems for internal combustion engines are known. These systems pass an electrical current through water to produce hydrogen and oxygen (and other gasses) through electrolysis. The prior art systems, however, are inefficient in their use of electricity to produce the resultant gases. Some of the causes of these inefficiencies include poor water atomization, undersized electrodes, and short residence times in the electrolytic cell.

Thus, a hydrogen production system for internal combustion engines solving the aforementioned problems is desired.

SUMMARY

The hydrogen production system for internal combustion engines includes one or more pass-through electrolysis cells for splitting water into hydrogen and oxygen, just prior to injection into a combustion chamber of the engine. Water and air are mixed together at high speeds in a vacuum chamber to form a water vapor that is fed to the pass-through electrolysis cells. As the water vapor passes through the electrolysis cells, it is subjected to electromagnetic fields, thereby separating the water vapor into hydrogen and oxygen. The combined water vapor, hydrogen, and oxygen are expelled into the engine's intake manifold just prior to the combustion chamber(s) of the engine. The system can include a main electrolysis cell, auxiliary electrolysis cells for each cylinder of the engine or a combination of both. Electrical power to the electrolysis cells is controlled by a vacuum sensor switch. The system can produce an ideal fuel mixture for any of various fuels, including, gasoline, natural gas, LP gas, compressed natural gas, methane gas, methanol, biogas, and other vapor gas combinations.

Applications of the hydrogen production system extend beyond internal combustion engines and include, but are not limited to, liquid and steam water molecule treatments for: plant roots, leaves and ambient absorption; improved sewage treatment processes; improved absorption and uptake for human and many species of animals and fish; improved absorption for agriculture foliar herbicide and pesticide; and improved absorption in both ariel and flood, soil-based moisture delivery. Other applications include: molecular hydrogen production for agriculture and human health; inline clean hydrogen production and/or charged water production for various industries; expanded and charged water for several food and non-food applications; hydrogen heating and cooling (absorption); and carbon cleaning via mixed media intake and syngas production.

These and other features of the present subject matter will become readily apparent upon further review of the following specification.

BRIEF DESCRIPTION OF THE DRAWINGS

FIG. 1 is a side view of the air scoop of FIG. 10, showing the air scoop installed in the wall of an air intake system of an ICE.

Similar reference characters denote corresponding features consistently throughout the attached drawings.

DETAILED DESCRIPTION OF THE PREFERRED EMBODIMENTS

Figure 1:
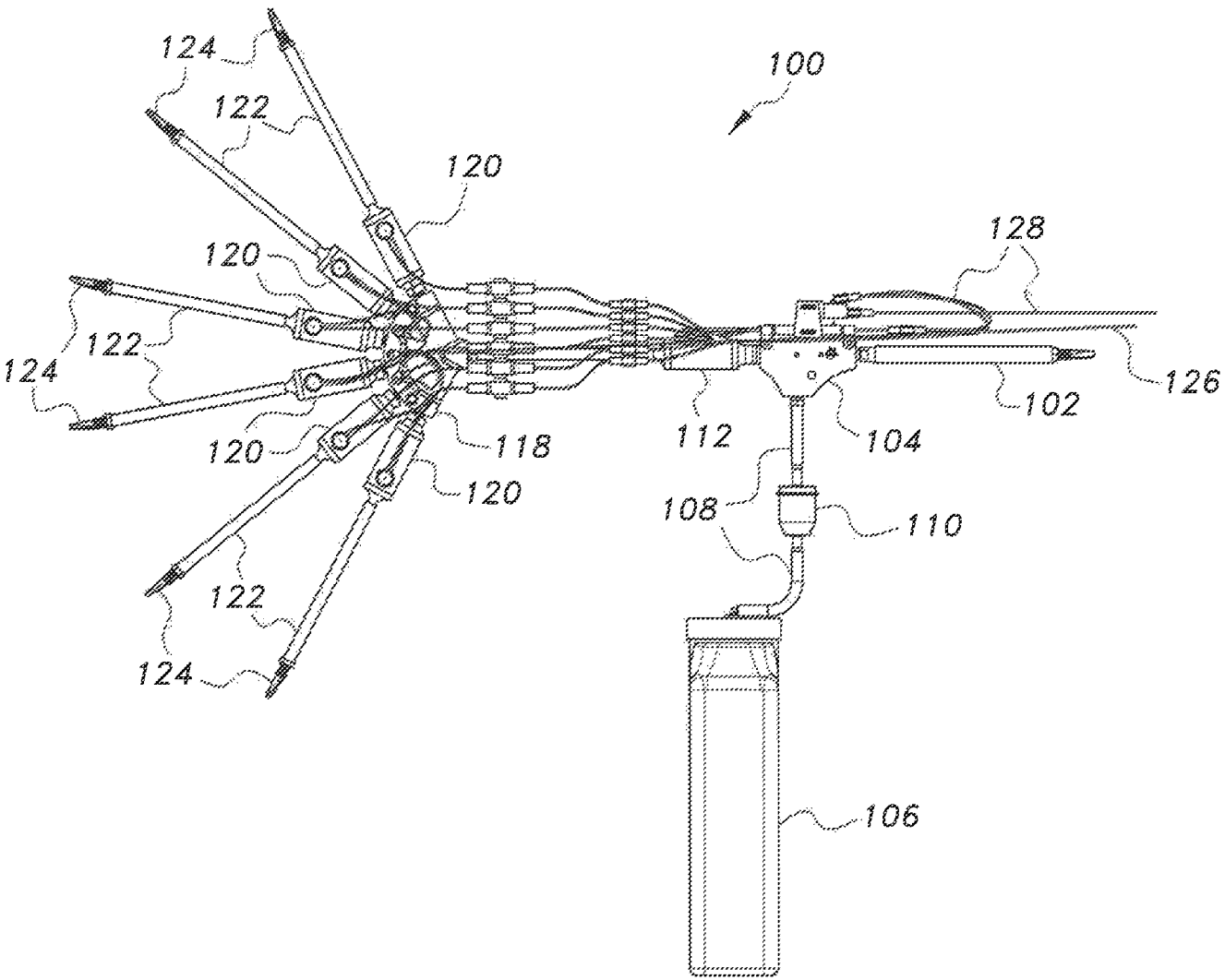
FIG. 1 is a diagrammatical view of a hydrogen production system for internal combustion engines.
Figure 2:
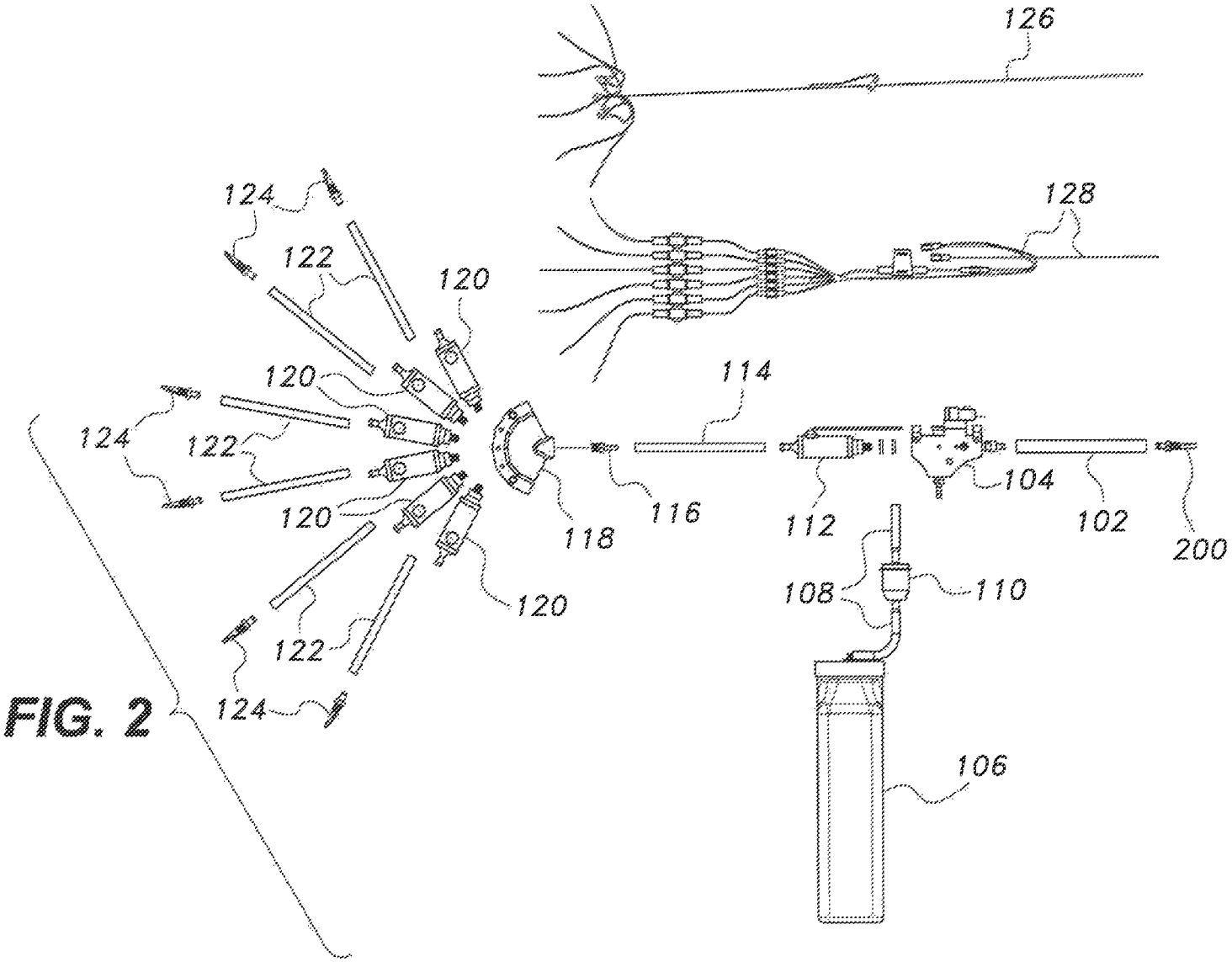
FIG. 2 is an exploded, diagrammatical view of the hydrogen production system of FIG. 1.

The hydrogen production system for internal combustion engines 100 is shown in FIGS. 1-2. The system 100 can be added to an air intake system of a vehicle's engine to enhance the combustion of the native fuel being used in the internal combustion engine (ICE). Typical native fuels used by ICEs are gasoline, natural gas, LP gas, compressed natural gas, methane gas, methanol, bio gas, and other vapor gas combinations. The system 100 is not intended to replace the vehicle's factory fuel system or the required use of standard fuel or alternate fuel for the vehicle. In addition, the system 100 does not attach to or require modification of the existing fuel system in the engine. The system relies on the existing electronic control module (ECM) or engine control unit (ECU), to regulate the air fuel ratio, and the consumption rate of the native fuel. When added to the engine's air intake system, the system 100 reduces emissions, increases fuel efficiency and actively avoids carbon buildup in the ICE. These features provide for improving air quality in the engine's surrounding environment. In addition, the health and longevity of the host ICE is improved by reducing carbon buildup, toxic exhaust gases, and excessive heat in the engine's exhaust and oil.

The system 100 includes an air intake scoop 200, a vacuum block 104 having an air input port system for receiving air from the intake air scoop 200, a water reservoir 106 connected to the vacuum block 104 for providing water to be mixed with the air in the vacuum block 104, at least one primary hydrogen generator assembly 112 with an inlet port for receiving the air/water vapor mixture from the vacuum block 104 and producing a mixture of hydrogen, produced oxygen, and fine hydrogen production vapor from a partially oxidized water fog, and a plurality of secondary hydrogen generator assemblies 120 connected to the primary generator assembly 112 for receiving this mixture. The engine vacuum draws this mixture into the intake manifold to provide an ideal fuel mixture for the engine.

Air travels from the atmosphere into the vehicle's air filter box. The system 100 draws air from the mass air sensor of the ICE outside the filter box. Air enters the system 100 through an air intake system that includes an air intake tube 102 and an intake air scoop 200. The mass air sensor measures the total air volume (including what flows through the system 100) consumed by the engine and the engine ECM or ECU regulates the fuel delivery according to the mass of air being consumed by the engine. The small portion of air that enters the system 100, bypasses the engine's idle air control valve (which auto corrects for the difference), as well as the engine's throttle body. The air then enters the vacuum block 104 where the air is mixed with vaporized water, as described below with respect to FIGS. 3-5. Water is supplied to the vacuum block 104 from the water reservoir 106, via water supply tubing 108 and a water filter 110. The air and water vapor mixture enters the primary hydrogen generator assembly 112 where the mixture is partially cracked into charged and partially oxidized water fog, as described in further detail below with respect to FIGS. 6-9. The mixture enters a distribution manifold 118 via tubing 114 and connection nipple 116. The mixture is distributed into the six secondary hydrogen generator assemblies 120. The mixture from each of the secondary hydrogen generator assemblies 120, is fed into a corresponding cylinder via tubes 122 and output air scoops 124. The output air scoops 124 are tapped into the air intake manifold of the ICE directly before their corresponding cylinder intake valve (not shown), as described in further detail with respect to FIGS. 10-11. It should be understood that while a six-cylinder system is shown, the hydrogen production system for internal combustion engines 100 can be used with any number of cylinders or other fuel consuming devices. A ground wire harness 126 connects the various components to the vehicle ground via the battery or other ground connection, while a positive wire harness 128 connects the system 100 to the vehicle's positive 12 VDC system via the battery or other 12 VDC connection.

Figure 4:
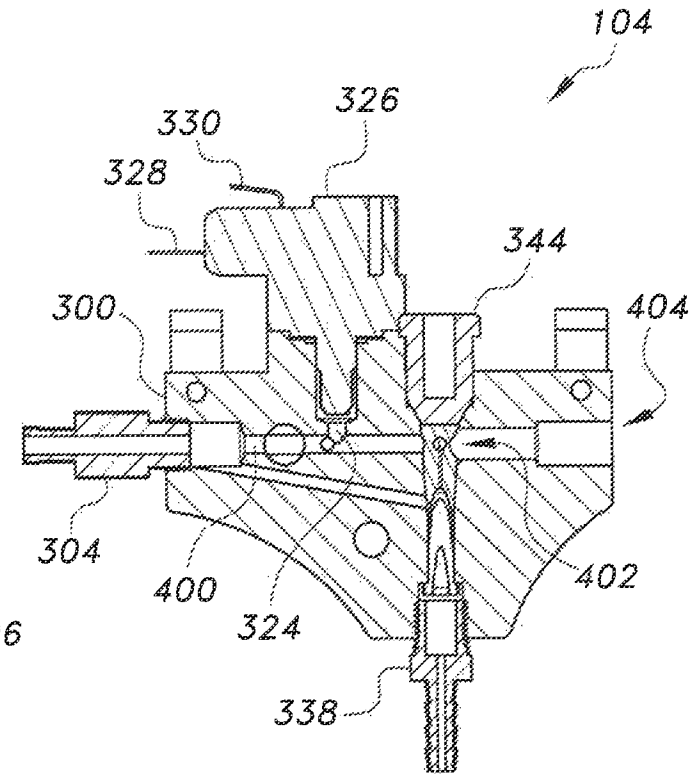
FIG. 4 is a cross sectional view of the vacuum block assembly of FIG. 2, taken through the centerline of the assembly.
Figure 3:
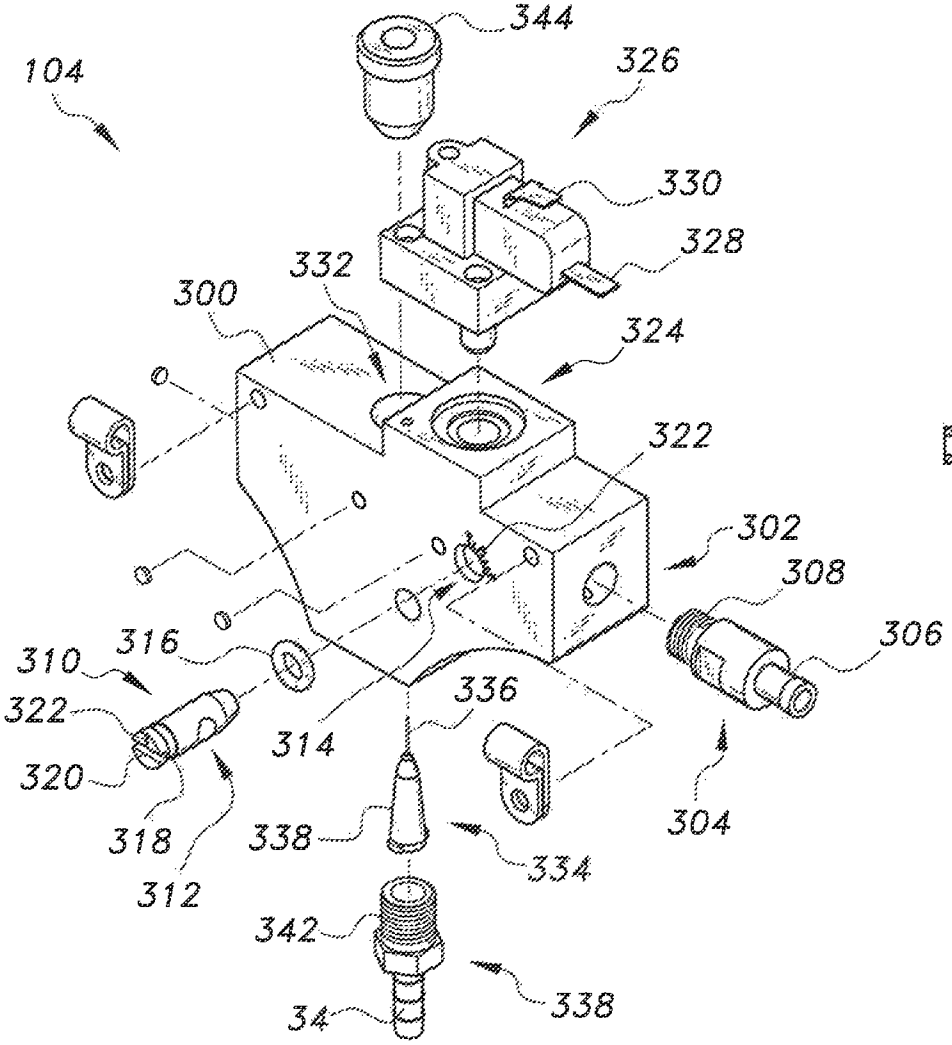
FIG. 3 is an exploded, perspective view of a vacuum block assembly of the hydrogen production system of FIG. 1, showing the various components thereof.
Figure 5:
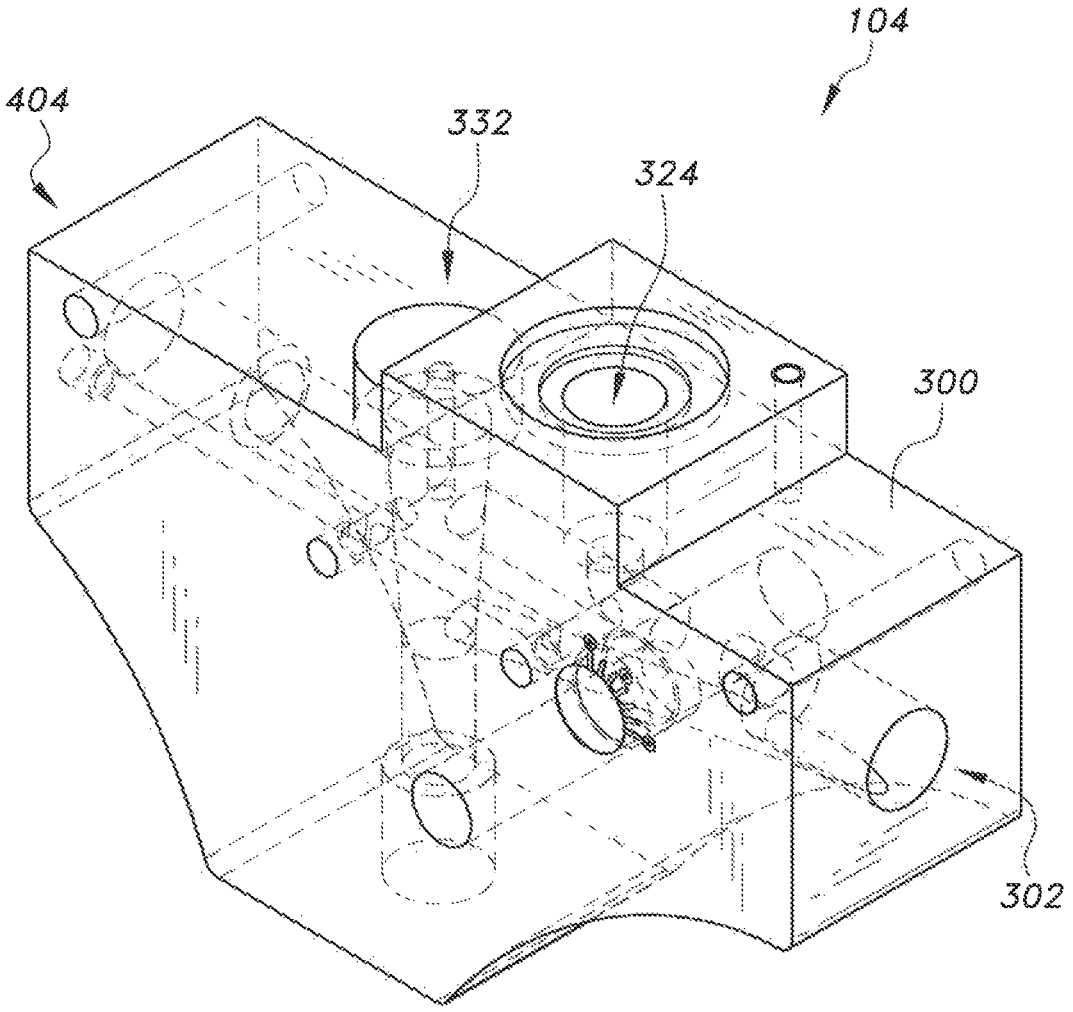
FIG. 5 is a transparent, perspective view of the vacuum block of FIG. 2, showing the various passageways therethrough.

The details of the vacuum block 104 are shown in FIGS. 3-5. The vacuum block 104 includes a vacuum block body 300. The air intake tube 102 connects to an air input port 302 in the vacuum block body 300 via a hose adapter 304. The hose adapter 304 has a tube connection nipple 306 at its distal end, for insertion into the air intake tube 102, and external threads 308 on its proximate end for engaging internal threads in the air input port 302. The air input port 302 leads to a reduced diameter, horizontal, main passageway 400. An airflow valve 310 allows for manual regulation of the velocity and volume of air traveling through the main passageway 400. The airflow valve 310 is substantially cylindrical and includes a valve passageway 312 that aligns with the main passageway 400, when the airflow valve 310 is in the fully "on" position. The airflow valve 310 is positioned in a horizontal, transverse blind bore 314 in the vacuum block body 300 that intersects the main passageway 400 at approximately a right angle. An O-ring 316 is positioned in a groove 318 in the airflow valve 310 to thereby seal the blind bore 314 when the airflow valve 310 is positioned within the blind bore 314. The outer surface of the airflow valve 310 is substantially planar and includes a linear groove 320 for receipt of a tool, such as a flat tip screwdriver, for adjusting the airflow valve 310. Indicia 322, in the form of short lines on the outer surface of the airflow valve 310 and the side of the vacuum block body 300 around the blind bore 314, can indicate the position (and degree of opening) of the airflow valve 310.

A first vertical bore 324 extends from the top of the vacuum block body 300 to the main passageway 400. A vacuum sensor switch 326 is positioned within the first vertical bore 324 to sense the pressure of the metered air flow in the main passageway 400. The vacuum sensor switch 326 includes a first blade connector 328 that is connected to 12 VDC via the positive wire harness 128. A second blade connector 330 is electrically connected to the primary hydrogen generator assembly 112 and the secondary hydrogen generator assemblies 120, also via the positive wire harness 128. When the engine is not running or has very low vacuum, there is no, or insufficient, vacuum in the main passageway 400 to trigger the vacuum sensor switch 326, and electrical power to the hydrogen generator assemblies 112, 120 is turned off. However, when the vacuum in the main passageway 400 is sufficient to trigger the vacuum sensor switch 326, electrical power is supplied to the hydrogen generator assemblies 112, 120.

A second vertical bore 332 extends from the top of the vacuum block body 300 to the bottom of the vacuum block body 300 and intersects the main passageway 400 at approximately a right angle, thereby forming a velocity chamber 402. A hydronic injection needle 334 is positioned within the second vertical bore 332 and includes a narrow diameter needle 336 with a tip that is positioned in the approximate center of the main passageway 400 and a base 338. Preferably, the base 338 is formed of plastic and the needle 336 is stainless steel with a 32 gauge needle orifice. A water inlet port including a hose adapter 338 having a tube connection nipple 340 at its distal end, for insertion into water supply tubing 108, and external threads 342 on its proximate end for engaging internal threads in the bottom of the second vertical bore 332, to thereby retain the hydronic injection needle 334 within the bottom of the second vertical bore 332 and to provide water from the water reservoir 106 to the hydronic injection needle 334. A rubber plug 344 seals the upper end of the second vertical bore 332 and closes off the velocity chamber 402. As air is drawn through passageway 400, a vacuum is formed in the velocity chamber 402, thereby drawing water out of the water reservoir 106, through the water supply tubing 108, the water filter 110 and the narrow diameter needle 336. The air flow causes the nan-ow diameter needle 336 to vibrate, thereby further atomizing (vaporizing) the water as it exits the narrow diameter needle 336. The mixture swirls in the velocity chamber, thoroughly mixing the air and water vapor. The mixed air and water vapor exits vacuum block body 300 via a vacuum block exit port 404 and enters the primary hydrogen generator assembly 112.

Figure 6:
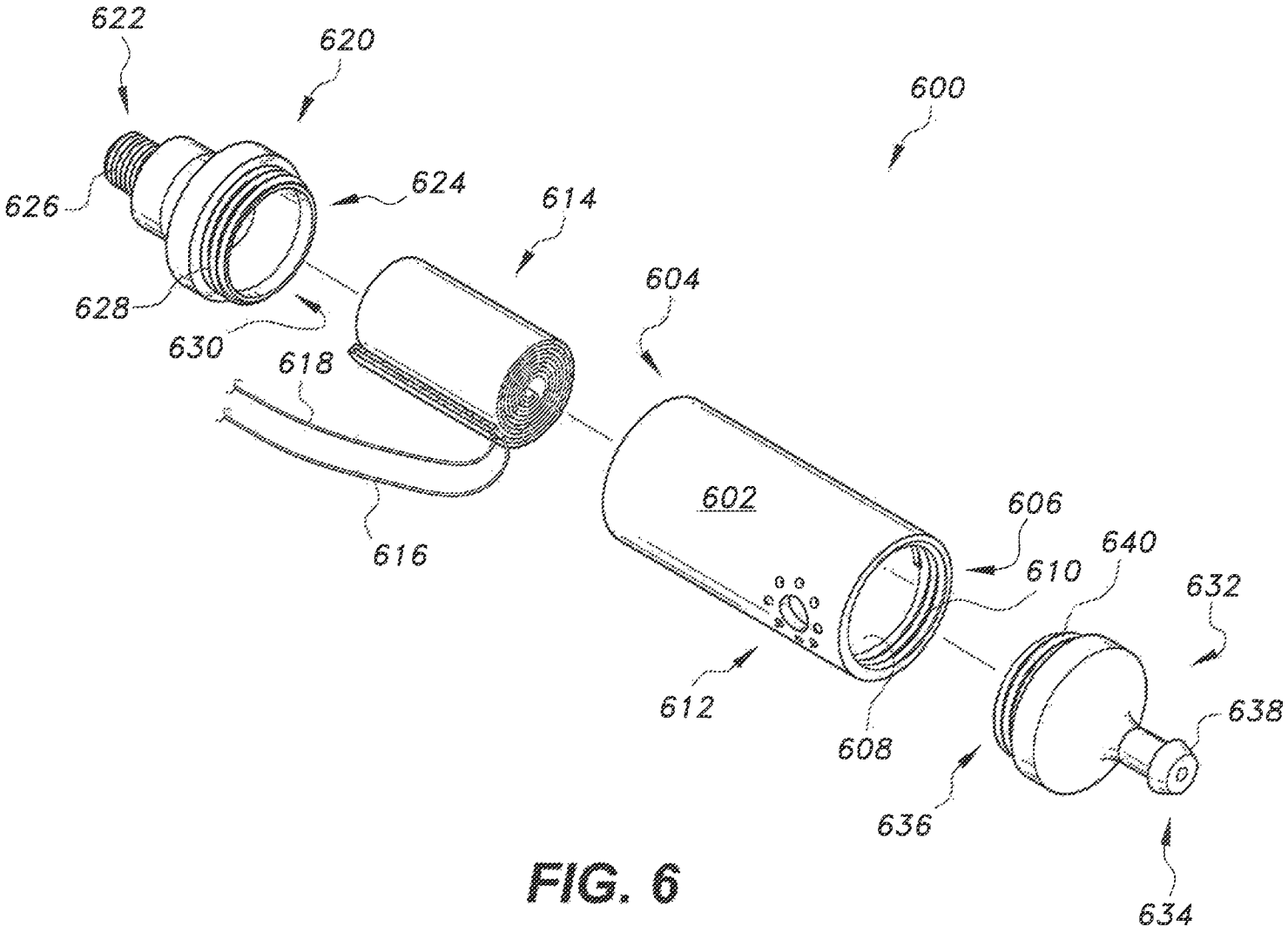
FIG. 6 is an exploded, perspective view of a hydrogen generator assembly of the hydrogen production system of FIG. 1.

The details of the primary hydrogen generator assembly 112 and the secondary hydrogen generator assemblies 120 are shown in FIGS. 6-9. An embodiment of the hydrogen generator assembly, designated 600, is shown in FIG. 6. While the hydrogen generator assembly 600 is an important component of the hydrogen production system for internal combustion engines 100, it is important to note that the hydrogen generator assembly 600 has separate utility both in internal combustion engines, as well as other applications. It is also important to note, that while the assembly 600 is referred to as a hydrogen generator, it may be used with various gas and liquid combinations to produce a wide variety of fuel compositions. Hydrogen, oxygen and ammonia are examples of gases that may be produced from both initial reactions as well as secondary reactions of produced and introduced input gases such as hydrogen, produced oxygen, introduced oxygen, introduced atmospheric air (including nitrogen, carbon dioxide, oxygen and other trace elements). By adjusting the input gas, the assembly 600 is capable of producing a fuel air mixture that is ideal for the particular engine or application. A key advantage of the hydrogen generator assembly 600 when compared to prior art hydrogen generators is the efficiency of the gas production, using a minimum of electric power (less than 1 Amp×12 Volt DC=12 Watts), while also not increasing in temperature, when used as designed. Also of note is that the hydrogen generator assembly 600 does not require electrical controls to avoid electrical run away, thus the hydrogen generator assembly 600 can be entirely self-regulated. Because the hydrogen generator assembly 600 can be self-regulated, it also provides a high-level of security and safety for the end-user. For most turbocharged applications, hydrogen generator assembly 600 can be used with water vapor applied via a high pressure pump and sprayer system, (not shown).

With reference to FIG. 6, the hydrogen generator assembly 600 is shown in an exploded, disassembled view. The hydrogen generator assembly 600 includes a generator body 602. The generator body 602 is generally cylindrical and includes an input end 604, an output end 606 and a hollow interior with an inner surface 608. Both the input end 604 and the output end 606 include internal (female) threads 610 on the inner surface 608 adjacent the input end 604 and the output end 606. An electrical access port 612 extends through the side of the generator body 602. A generator coil 614 is positioned within the hollow interior of the generator body 602 and includes a negative input wire 616 and a positive input wire 618 that extend through the electrical access port 612 of the generator body 602. The details of the generator coil 614 are described below with respect to FIGS. 7-9. An input end cap 620 seals the input end 604 of the generator body 602 and includes an outer end 622 and an inner end 624. The outer end 622 includes an inlet port with exterior (male) threads 626 that engage interior threads in the vacuum block exit port 404 and the exit ports in the distribution manifold 118. While a threaded connection is described herein, it should be understood that any suitable attachment mechanism can be employed. The inner end 624 includes exterior (male) threads 628 that engage the interior threads (not shown) on the inner surface 608 adjacent the input end 604 of the generator body 602. The interior 630 of the input end cap 620 is hollow to allow for the passage of fluids therethrough from the inlet port. An output end cap 632 seals the output end 606 of the generator body 602 and includes an outer end 634 and an inner end 636. The outer end 634 has an outlet port with a tube connection nipple 638 at its distal end, for insertion into the tubing 114. It should be understood that means of attachment other than a tube connection nipple can alternatively be used, depending on the particular application. The inner end 636 includes exterior (male) threads 640 that engage the interior threads 610 on the inner surface 608 adjacent the output end 606 of the generator body 602. The interior of the output end cap 632 is hollow to allow fluids to pass therethrough to the outlet port.

Figure 7:
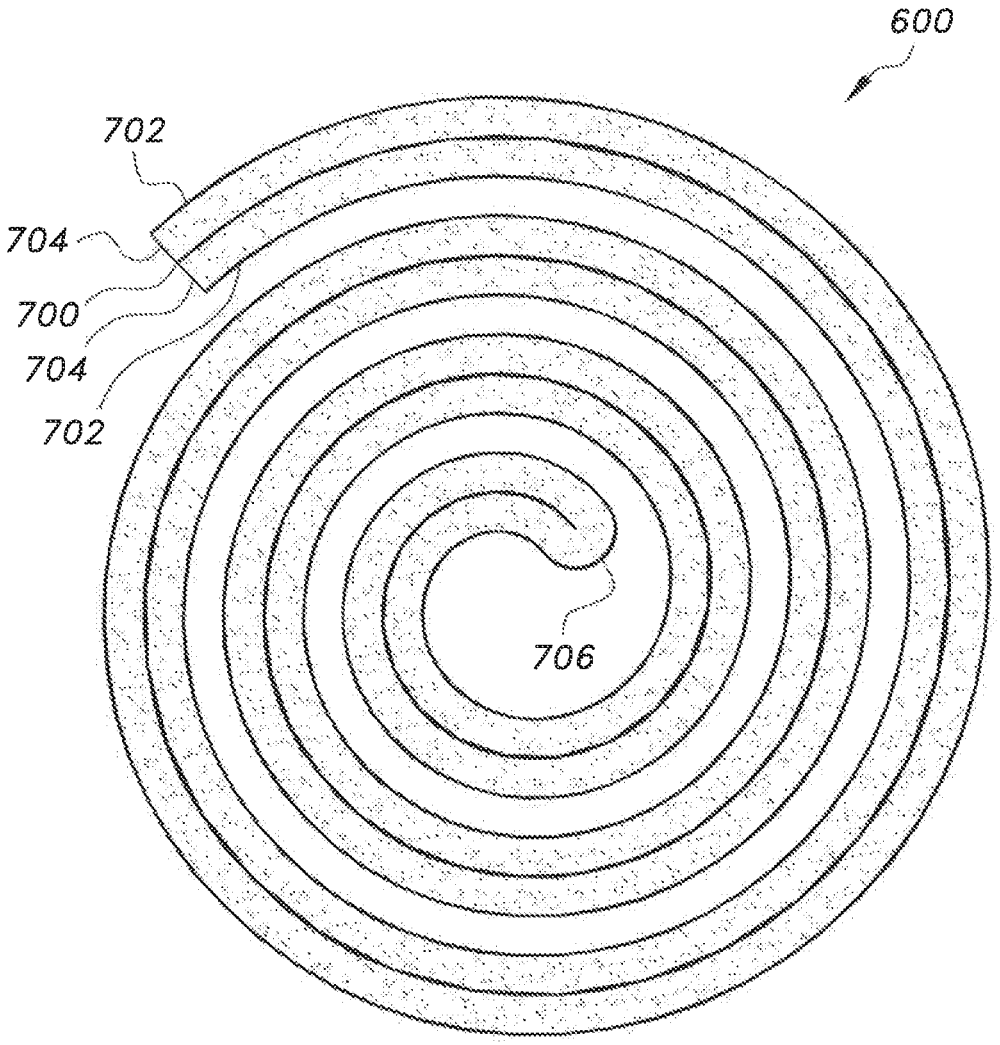
FIG. 7 is an end view of a generator coil of the hydrogen generator assembly of FIG. 6.
Figure 8:
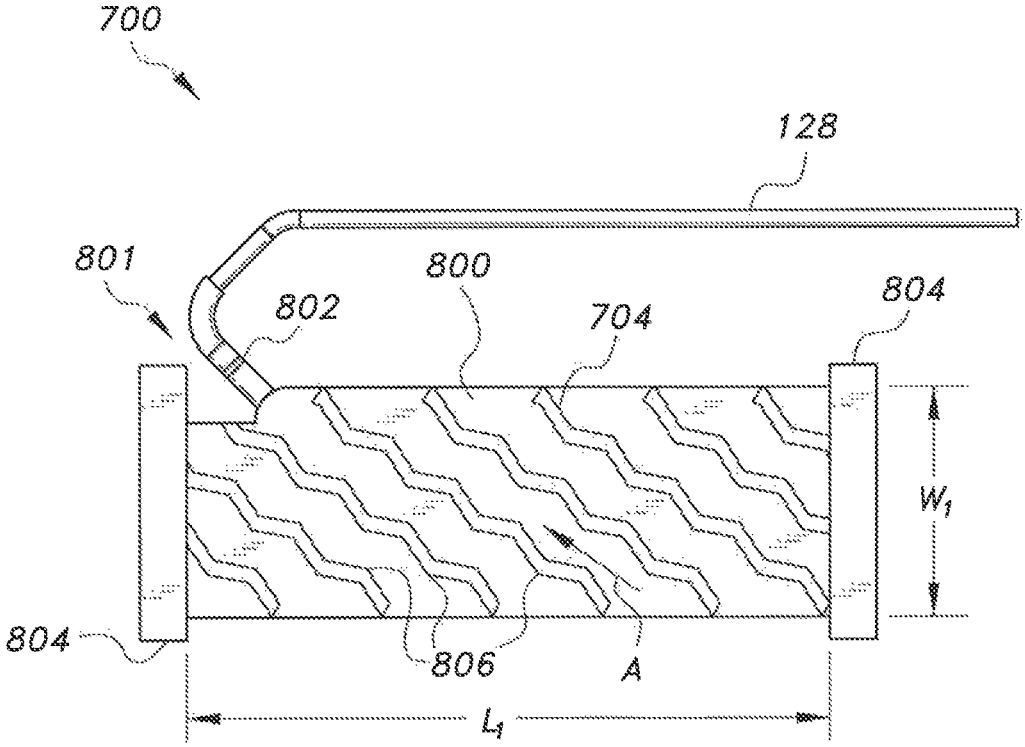
FIG. 8 is a top view of a positive plate assembly for the generator coil of FIG. 7.
Figure 9:
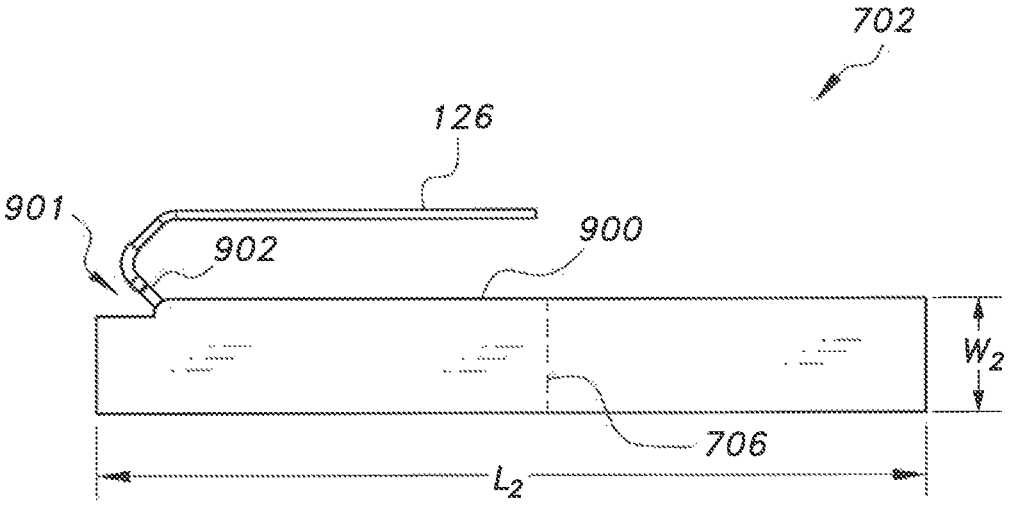
FIG. 9 is a top view of a negative plate assembly for the generator coil of FIG. 7.

The details of the generator coil 614 are shown in FIGS. 7-9. FIG. 7 shows an end view of the generator coil 614. The coil includes a negative plate 702 wrapped around a positive plate 700 with elastomeric, electrical insulators 704 interposed between the negative plate 702 and the positive plate 700. In FIG. 7, at the center 706 of the coil, the negative plate 702 is wrapped around the end the positive plate 700. The details of one side of the positive plate 700 and the electrical insulators 704 are shown in FIG. 8. The opposite side of the positive plate 700 is a mirror image of the side shown, including the electrical insulators 704. The positive plate 700 includes a positive plate body 800 that is generally rectangular with a length L1 and a width W1. A notch 801 may be provided at one end of the positive plate body 800 to allow room for a positive wire connector 802 that connects the positive plate body 800 to the positive wire harness 128, or other voltage source. The ends of the positive plate 700 include end insulator strips 804 for insulating the positive plate 700 and the negative plate 702 from one another. The electrical insulators 704 are arranged in a diagonal configuration, such that the airflow as shown by arrow A, travels through the generator coil 614 in generally helical flow channels formed by the negative plate, the positive plate and the plurality of electrical insulators. The helical flow channels increase the residence time of the fluid mixture as it travels through the generator coil 614, as opposed to straight (axially extending) flow channels. In addition, each of the electrical insulators 704 include a number of bends 806, such that they are undulating and, thereby, further increasing the residence time of the fluid mixture as it travels through the generator coil 614.

The details of the negative plate 702 are shown in FIG. 9. The negative plate 702 includes a negative plate body 900 that is generally rectangular with a length L2 and a width W2. A notch 901 may be provided at one end of the negative plate 702 to allow room for a negative wire connector 902 that connects the negative plate body 900 to the negative wire harness 126, or other ground source. The negative plate 702 is approximately twice as long as the positive plate 700 such that L2~2L1, and has approximately the same width as the positive plate 700 such that W2~W1. Therefore, to form the generator coil 614, the negative plate 702 is first wrapped around the positive plate 700, such that the ends of the negative plate 702 are both at a first end of the positive plate 700 on opposite sides of the positive plate 700, and insulated therefrom by one of the end insulator strips 804, while the negative plate 702 is wrapped around the second end of the positive plate 700, and insulated therefrom by the other end insulator strip 804. This entire assembly is then wrapped up starting at the second end of the positive plate 700, to form the generator coil 614 as best seen in FIGS. 6-7.

Figure 10:
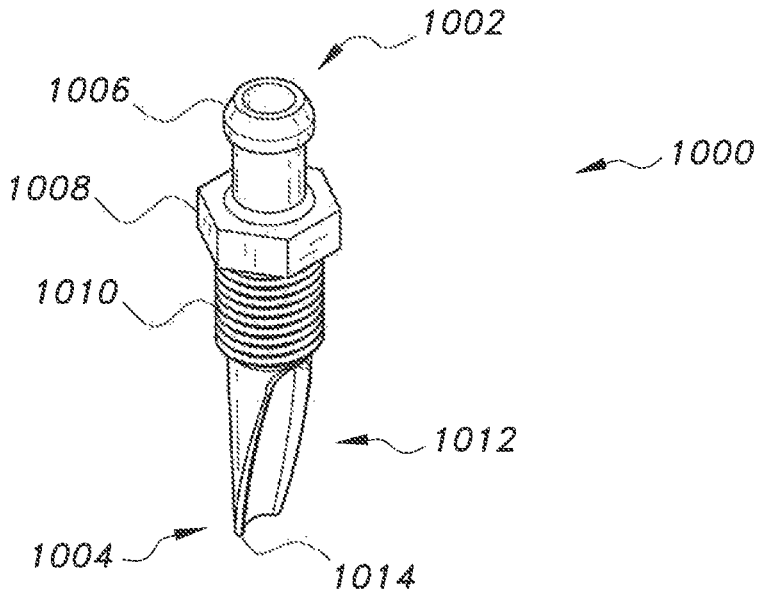
FIG. 10 is an isometric view of an air scoop of the hydrogen production system of FIG. 1.
Figure 11:
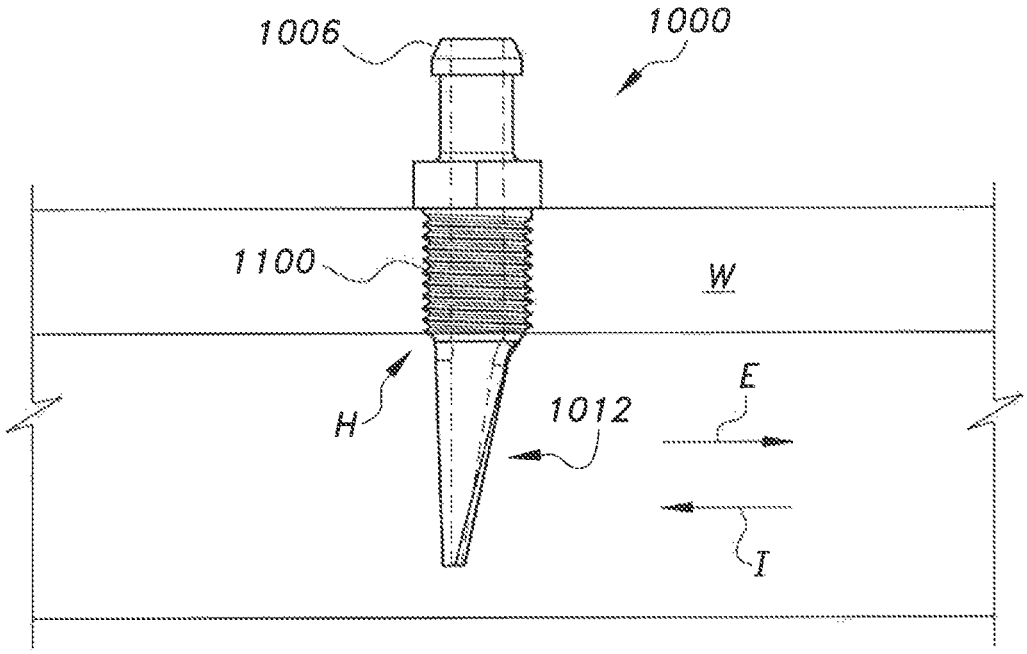

The details of the intake air scoop 200 and the output air scoops 124 are shown in FIGS. 10-11 with respect to air scoop 1000. The air scoop 1000 includes a first end 1002 and a second end 1004. The first end 1002 has a tube connection nipple 1006 for insertion into either the air intake tube 102 in the case of the intake air scoop 200, or tubes 122 in the case of the output air scoops 124. Adjacent to the tube connection nipple 1006, a hexagonal portion 1008 is provided for engagement by a wrench or other tool, to install or remove the air scoop 1000. External (male) threads 1010 extend from the hexagonal portion 1008 to the second end 1004 for engaging threads 1100 that are tapped into a hole H in a wall W of the ICE's air intake system. The second end 1004 has an opening 1012 defined along a sidewall of the air scoop 1000. FIG. 11 illustrates the air scoop 1000 extending through a hole H of a wall W of the air intake system. In the case of the intake air scoop 200, the hole H is formed directly after the mass air sensor of the ICE (not shown), and the airflow is shown as arrow I. In this position, the opening 1012 assists in directing air into the hydrogen production system 100. In the case of the output air scoops 124, the hole H is formed directly before the corresponding cylinder intake valve (not shown), and the airflow is shown as arrow E. In this position, the opening 1012 assists in pulling air out of the hydrogen production system 100.

It is to be understood that the hydrogen production system for internal combustion engines is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A hydrogen generator assembly comprising:
- a generally cylindrical generator body having an input end, an output end, and a hollow interior;
- a generator coil positioned within the hollow interior of the generator body, the generator coil comprising:
  - a generally rectangular negative plate;
  - a generally rectangular positive plate;
  - a plurality of electrical insulators interposed between the negative plate and the positive plate;
  - an input end cap removably connected to the input end of the generator body, the input end cap including an input port; and
  - an output end cap removably connected to the output end of the generator body, the output end cap including an outlet port,
- wherein the negative plate is wrapped around the positive plate and the plurality of electrical insulators, and
- wherein a plurality of substantially helical flow channels are formed between the electrical insulators.

2. The hydrogen generator assembly of claim 1, wherein the substantially helical flow channels are undulating.

3. A hydrogen production system, comprising:
- an air intake scoop;
- a water reservoir;
- a vacuum block having an air input port system for receiving air from the air intake scoop, a water inlet port for receiving water from the water reservoir, and an exit port, the vacuum block configured for mixing the air and water to form an air/water vapor mixture;
- at least one hydrogen generator assembly with an inlet port for receiving the air/water vapor mixture from the vacuum block exit port, a generator coil with a negative plate and a positive plate for producing hydrogen and oxygen from the air/water vapor mixture and an outlet port for outputting the air/water vapor mixture and the produced hydrogen and oxygen;
- a ground wire harness that connects the negative plate of the at least one hydrogen generator to a ground source; and
- a positive wire harness that connects the positive plate of the at least one hydrogen generator to a positive voltage source.

4. The hydrogen production system of claim 3, wherein the at least one hydrogen generator assembly comprises:
- a generally cylindrical generator body having an input end, an output end and a hollow interior;
- a generator coil positioned within the hollow interior of the generator body, the generator coil comprising:
- a generally rectangular negative plate;
- a generally rectangular positive plate;
- a plurality of electrical insulators interposed between the negative plate and the positive plate;
- an input end cap removably connected to the input end of the generator body, the input end cap including an input port; and
- an output end cap removably connected to the output end of the generator body, the output end cap including an outlet port,
- wherein the negative plate is wrapped around the positive plate and the plurality of electrical insulators and a plurality of substantially helical flow channels are formed between the electrical insulators.

5. The hydrogen production system of claim 4, wherein the substantially helical flow channels are undulating.

6. The hydrogen production system of claim 5, wherein the hydrogen production system is configured for an internal combustion engine and further comprises a distribution manifold having an input port connected to the outlet port of the at least one hydrogen generator, and a plurality of outlet ports connected to a vehicle air intake system via a plurality of tubes and output air scoops.

7. The hydrogen production system of claim 6, wherein:
- the at least one hydrogen generator assembly comprises a main hydrogen generator assembly and a plurality of secondary hydrogen generator assemblies, the main hydrogen generator assembly extending between the vacuum block exit port and the input port of the distribution manifold and the plurality of secondary hydrogen generator assemblies extending between the plurality of outlet ports of the distribution manifold and the plurality of tubes.

8. The hydrogen production system of claim 7, wherein:
- the vehicle air intake system includes an air intake manifold; and
- each of the plurality of output air scoops is mounted in the air intake manifold.

9. The hydrogen production system of claim 8, wherein each of the plurality of output air scoops comprises:
- a sidewall;
- a first end with a tube connection nipple for insertion into a corresponding one of the plurality of tubes; and
- a second end with an opening defined along a sidewall of the air scoop.

10. The hydrogen production system of claim 9, wherein:
- the vehicle air intake system includes a mass air sensor.

11. The hydrogen production system of claim 10, wherein the hydrogen production system further comprises an air intake tube between the air input port system of the vacuum block and the air intake scoop, the intake air scoop comprising:
- a sidewall;
- a first end with a tube connection nipple for insertion into the air intake tube; and
- a second end with an opening defined along a sidewall of the air intake scoop.

12. The hydrogen production system of claim 3, wherein the hydrogen production system is configured for an internal combustion engine and further comprises a distribution manifold with an input port connected to the outlet port of the at least one hydrogen generator, and a plurality of outlet ports connected to a vehicle air intake system via a plurality of tubes and output air scoops.

13. The hydrogen production system of claim 12, wherein:
- the at least one hydrogen generator assembly comprises a main hydrogen generator assembly and a plurality of secondary hydrogen generator assemblies;

the main hydrogen generator assembly extending between the vacuum block exit port and the input port of the distribution manifold; and the plurality of secondary hydrogen generator assemblies extending between the plurality of outlet ports of the distribution manifold and the plurality of tubes.

14. The hydrogen production system of claim 13, wherein:

the vehicle air intake system includes an air intake manifold; and each of the plurality of output air scoops is mounted in the air intake manifold.

15. The hydrogen production system of claim 13, wherein each of the plurality of output air scoops comprises:

a sidewall;

a first end with a tube connection nipple for insertion into a corresponding one of the plurality of tubes; and a second end with an opening defined along a sidewall of the air scoop.

16. The hydrogen production system of claim 15, wherein:

the vehicle air intake system includes a mass air sensor.

17. The hydrogen production system of claim 16, wherein the hydrogen production system further comprises an air intake tube between the air input port system of the vacuum block and the air intake scoop, the intake air scoop comprising:

a sidewall;

a first end with a tube connection nipple for insertion into the air intake tube; and a second end with an opening defined along a sidewall of the air intake scoop.

* * * * *